US005388687A

United States Patent [19]

Philip

[11] Patent Number: 5,388,687

[45] Date of Patent: Feb. 14, 1995

[54] PACKAGING DEVICES FOR BUNDLING PAPERS TO BE RECYCLED

[76] Inventor: Podimannil S. Philip, 95-14 127 St., Richmond Hill, N.Y. 11419

[21] Appl. No.: 243,215

[22] Filed: May 16, 1994

[51] Int. Cl.[6] ..... B65D 71/02; B65B 13/02

[52] U.S. Cl. ..... 206/83.5; 100/34; 100/912

[58] Field of Search ..... 206/83.5, 442; 100/2, 100/34, 912

[56] References Cited

U.S. PATENT DOCUMENTS

| | | | |
|---|---|---|---|
| 3,780,854 | 12/1973 | Ruppenthal | 100/34 |
| 5,004,099 | 4/1991 | Carpenter et al. | 206/83.5 |
| 5,009,153 | 4/1991 | Kaji | 100/34 |
| 5,109,762 | 5/1992 | Tetrault | 100/34 |
| 5,282,545 | 2/1994 | White | 206/83.5 |

*Primary Examiner*—Jimmy G. Foster

[57] ABSTRACT

A packaging device for bundling papers to be recycled comprising: a planar sheet of cardboard with an upper surface and a lower surface and formed of parallel sheets and a corrugated layer intermediate thereof, the cardboard being of a size and shape substantially that of a newspaper when folded; a paper cover in a rectangular configuration slightly larger than that of the cardboard, the paper cover being adhered over the majority of its central extent to the lower surface of the cardboard and with peripheral edges folded over and adhesively adhered to the upper surface of the cardboard around the periphery thereof, each side edge of the periphery being formed with a centrally located slot for the receipt of a tie string; and a pair of tie strings positionable at right angles to each other and crossing at the center point of the cardboard between the cardboard and the cover, the tie strings extending beyond the periphery of the cardboard and the cover to constitute tie strings positionable over a quantity of newspapers supported on the upper surface of the cardboard and the periphery.

3 Claims, 4 Drawing Sheets

FIG. 1
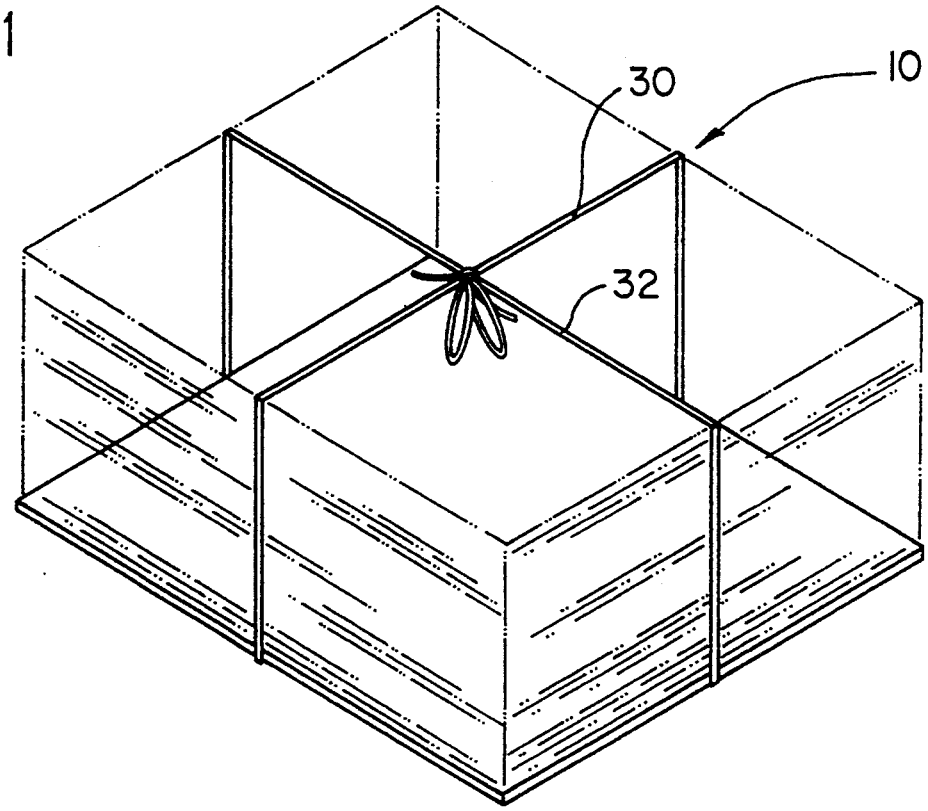
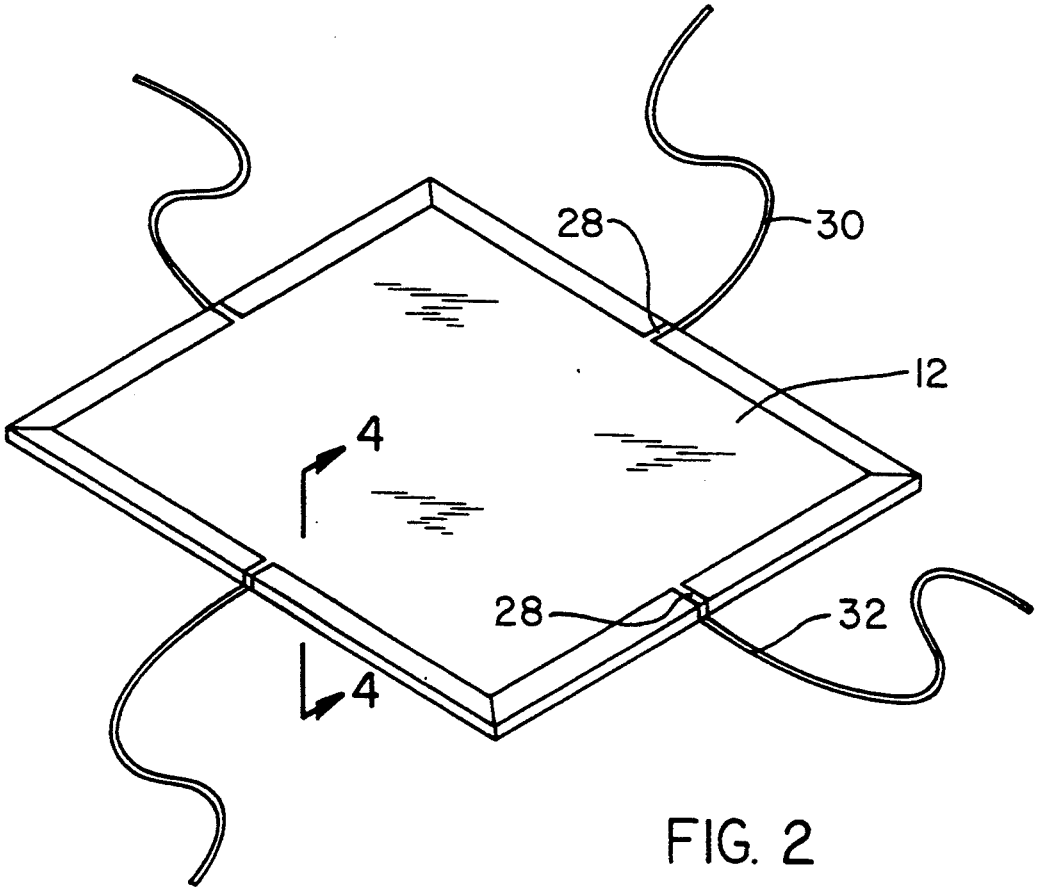
FIG. 2

FIG. 3
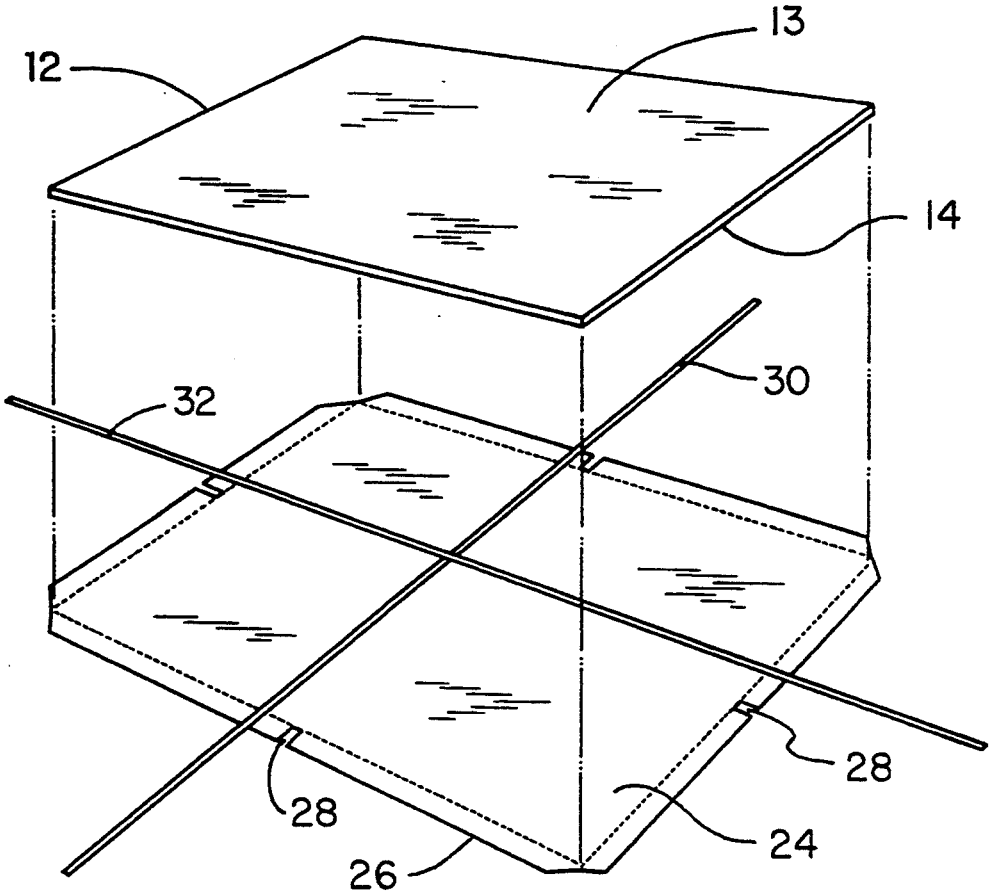
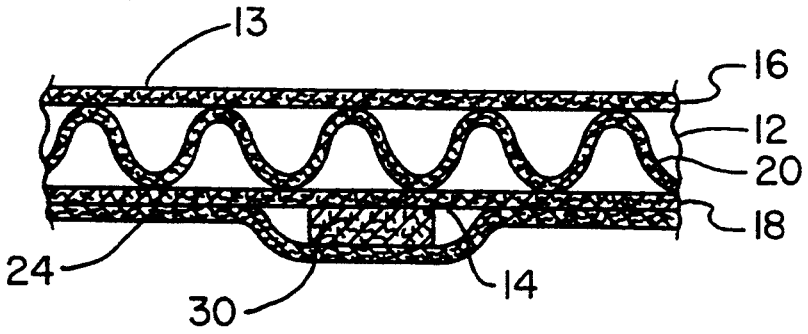
FIG. 4

FIG. 5
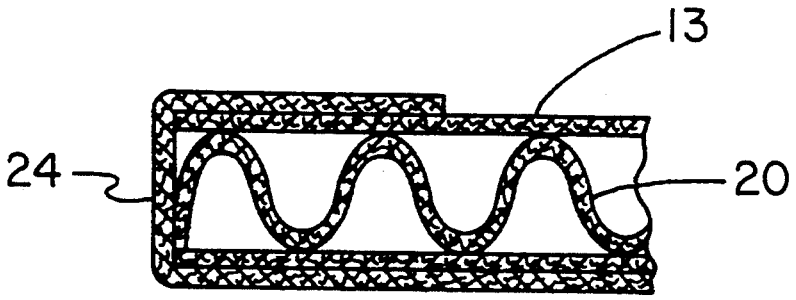
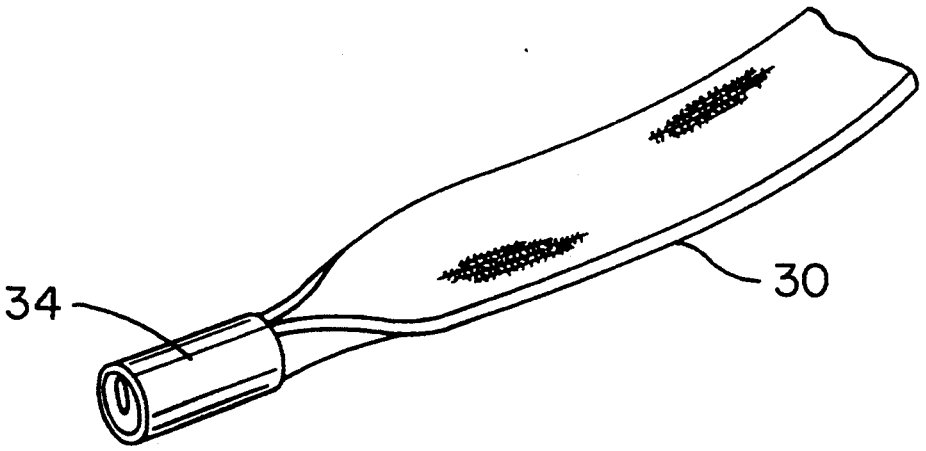
FIG. 6

PACKAGING DEVICES FOR BUNDLING PAPERS TO BE RECYCLED

BACKGROUND OF THE INVENTION

1. Field of the Invention

The present invention relates to packaging device for bundling papers to be recycled and more particularly pertains to bundling newspapers or other paper products for simplified handling prior to being recycled.

2. Description of the Prior Art

The use of packaging devices for various products including newspapers is known in the prior art. More specifically, packaging devices for various products including newspapers heretofore devised and utilized for the purpose of bundling articles to be held together for future use are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,104,960 a recycle paper collection receptacle device.

U.S. Pat. No. 4,962,973 discloses a portable recycle container assembly.

U.S. Pat. No. Des. 314,851 discloses the design of a recycle container.

U.S. Pat. No. Des. 323,573 discloses the design of a recycle container.

U.S. Pat. No. Des. 333,542 discloses the design of a waste container for recycle materials.

In this respect, the packaging device for bundling papers to be recycled according to the present invention substantially departs from the conventional concepts and designs of the prior art, and in doing so provides an apparatus primarily developed for the purpose of bundling newspapers or other paper products for simplified handling prior to being recycled.

Therefore, it can be appreciated that there exists a continuing need for new and improved packaging device for bundling papers to be recycled which can be used for bundling newspapers or other paper products for simplified handling prior to being recycled. In this regard, the present invention substantially fulfills this need.

SUMMARY OF THE INVENTION

In view of the foregoing disadvantages inherent in the known types of packaging devices for various products including newspapers now present in the prior art, the present invention provides an improved packaging device for bundling papers to be recycled. As such, the general purpose of the present invention, which will be described subsequently in greater detail, is to provide a new and improved packaging device for bundling papers to be recycled and method which has all the advantages of the prior art and none of the disadvantages.

To attain this, the present invention essentially comprises a new and improved packaging device for bundling papers to be recycled comprising, in combination: a planar sheet of cardboard with an upper surface and a lower surface and formed of parallel sheets and a corrugated layer intermediate thereof, the cardboard being of a size and shape substantially that of a newspaper when folded; a paper cover in a rectangular configuration slightly larger than that of the cardboard, the paper cover being adhered over the majority of its central extent to the lower surface of the cardboard and with peripheral edges folded over and adhesively adhered to the upper surface of the cardboard around the periphery thereof, each side edge of the periphery being formed with a centrally located slot for the receipt of a tie string; a pair of tie strings positionable at right angles to each other and crossing at the center point of the cardboard between the cardboard and the cover, the tie strings, extending beyond the periphery of the cardboard and the cover to constitute tie strings positionable over a quantity of newspapers supported on the upper surface of the cardboard and periphery, the ends of the strings including securement tape; and a supplemental sheet of cardboard of essentially the same size and shape as that of the sheet of cardboard and positionable over the topmost piece of paper in the stack on the cardboard, the strings being of sufficient length to extend upwardly over the newspaper and supplemental sheet of upper cardboard for tying thereof to create a secure bundle of newspapers for being recycled.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved packaging device for bundling papers to be recycled which have all the advantages of the prior art packaging devices for various products including newspapers and none of the disadvantages.

It is another object of the present invention to provide new and improved packaging device for bundling papers to be recycled which may be easily and efficiently manufactured and marketed.

It is further object of the present invention to provide new and improved packaging device for bundling papers to be recycled which are of durable and reliable constructions.

An even further object of the present invention is to provide new and improved packaging device for bundling papers to be recycled which are susceptible of a low cost of manufacture with regard to both materials and labor, and which accordingly are then susceptible of low prices of sale to the consuming public, thereby making such packaging device for bundling papers to be recycled economically available to the buying public.

Still yet another object of the present invention is to provide new and improved packaging device for bundling papers to be recycled which provide in the apparatuses and methods of the prior art some of the advantages thereof, while simultaneously overcoming some of the disadvantages normally associated therewith.

Still another object of the present invention is to bundling newspapers or other paper products for simplified handling prior to being recycled.

Lastly, it is an object of the present invention to provide new and improved packaging device for bundling papers to be recycled comprising: a planar sheet of cardboard with an upper surface and a lower surface and formed of parallel sheets and a corrugated layer intermediate thereof, the cardboard being of a size and shape substantially that of a newspaper when folded; a paper cover in a rectangular configuration slightly larger than that of the cardboard, the paper cover being adhered over the majority of its central extent to the lower surface of the cardboard and with peripheral edges folded over and adhesively adhered to the upper surface of the cardboard around the periphery thereof, each side edge of the periphery being formed with a centrally located slot for the receipt of a tie string; and a pair of tie strings positionable at right angles to each other and crossing at the center point of the cardboard between the cardboard and the cover, the tie strings extending beyond the periphery of the cardboard and the cover to constitute tie strings positionable over a quantity of newspapers supported on the upper surface of the cardboard and periphery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved packaging device for bundling papers to be recycled constructed in accordance with the principles of the present invention.

FIG. 2 is a perspective view of the device illustrated in FIG. 1 but prior to bundling of newspapers.

FIG. 3 is an exploded perspective illustration of the bundling device of the prior Figure.

FIG. 4 is a cross-sectional view of the device taken along lines 4—4 of FIG. 2.

FIG. 5 is an enlarged cross-sectional view of one edge of the cardboard the prior Figure.

FIG. 6 is a perspective illustration of a tie string and free end including a tape binder.

The same reference numerals refer to the same parts through the various Figures.

DESCRIPTION OF THE PREFERRED EMBODIMENT

Figure 7:
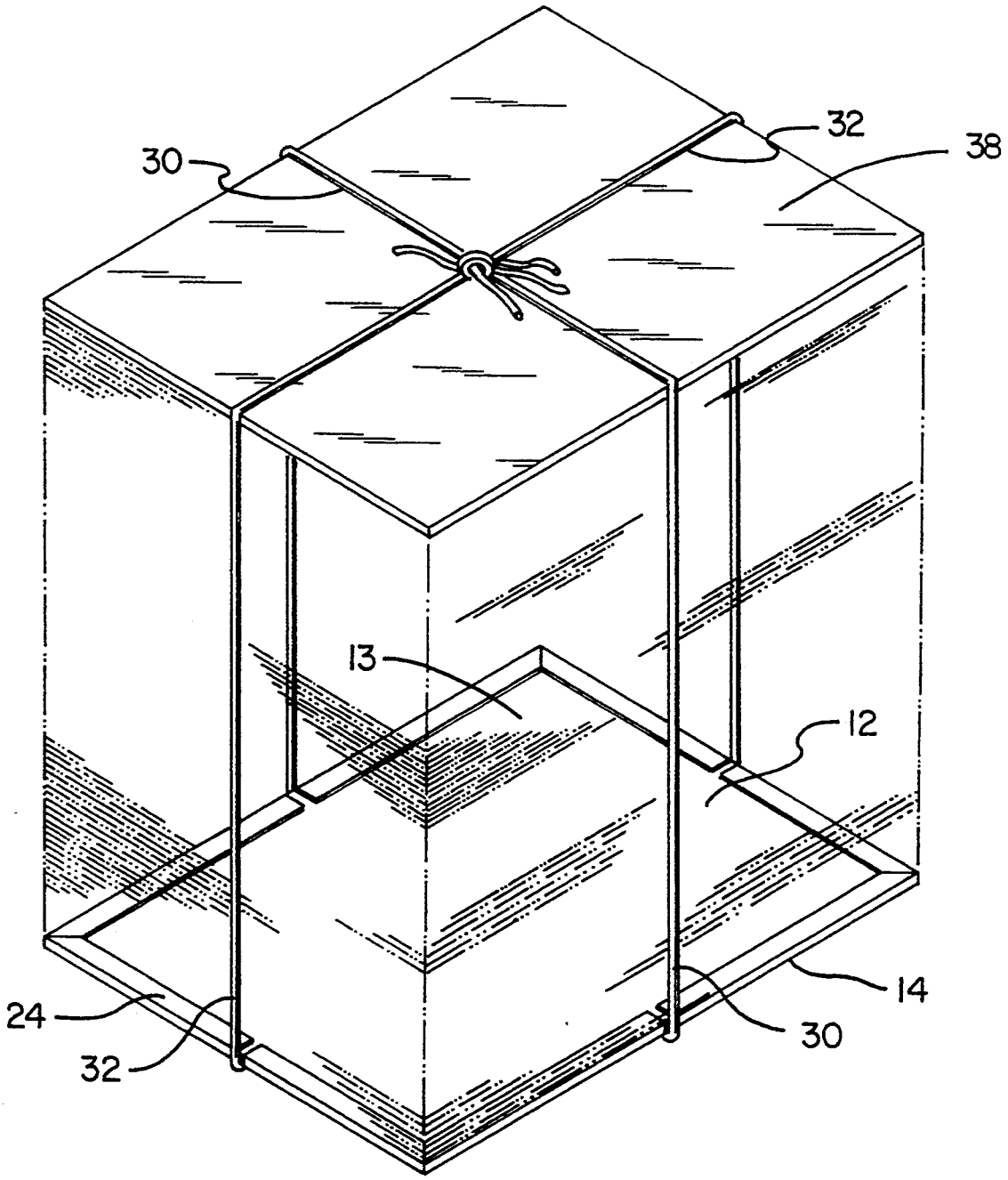
FIG. 7 is an illustration of an alternate embodiment of the invention, similar to FIG. 1, but having an upper cardboard sheet thereover.

With reference now to the drawings, and in particular to FIG. 1 thereof, the preferred embodiment of the new and improved packaging device for bundling papers to be recycled embodying the principles and concepts of the present invention and generally designated by the reference numeral 10 will be described.

The present invention, the new and improved packaging device for bundling papers to be recycled, is a system 10 comprised of a plurality of components. In their broadest context, such components include a planar sheet of cardboard, a paper cover, tie strings and a supplemental sheet of cardboard. Such components are specifically configured and correlated one with respect to the other to attain the desired objectives.

More specifically, the central component of the system 10 is a planar sheet 12 of cardboard. Such cardboard has an upper surface 13 and a lower surface 14. It is formed of parallel sheets 16 and 18 and has a corrugated layer 20 intermediate thereof. The cardboard is of a size and shape substantially that of a newspaper when folded.

Next provided is a paper cover 24. Such cover is in a rectangular configuration slightly larger than that of the cardboard. Such paper cover is adhered as by glue over the majority of its central extent to the lower surface of the cardboard. It has its enlarged peripheral edges 26 folded over and adhesively adhered, as through an adhesive, to the upper surface of the cardboard around the periphery of the cardboard. Each side edge of the periphery is formed with a centrally located slot 28. Such slot is for the purpose of receiving a tie string.

The tie strings 30 and 32 are the next component of the system 10. Such strings are positioned at right angles to each other. They cross at the center point of the cardboard adjacent its lower surface. They are located between the cardboard and the paper cover. The tie strings extend well beyond the periphery of the cardboard and the cover. They constitute tie strings positionable over a quantity of newspapers supported on the upper surface of the cardboard and the periphery. The ends of the strings are preferably made secure through the use of an adhesive securement tape 34.

The last component of the system is a supplemental sheet 38 of cardboard. Such supplemental sheet is essentially the same in size and shape and construction as that of the sheet 12 of cardboard first above described. The supplemental sheet 38 is adapted to be positioned over the topmost piece of paper in the stack of paper being tied. Note FIG. 1. The strings are of sufficient length to extend upwardly over the newspaper and supplemental sheet 38 of cardboard for the tying thereof. This resultantly creates a secure bundle of newspaper for being recycled when the strings are tied.

It should be understood that the present invention is not a toy or game for use by children. Care must be taken since the apparatus and its component elements as described herein are solely for a particular purpose as described herein.

Recycling has become a law in many cities in this country. Residents are required to recycle newspapers, junk mails and coupons. I have realized that packing and tying of paper items is very difficult. No standard dispensers are available in the market. The present invention is about making dispensers (packages) for recycling paper products. Cardboard base supports within and long strings (ties) preattached make it very easy to dispense newspapers and other paper products.

A cardboard size of about 15 inches×12 inches may be utilized for standard newspaper recycling packages. The string should be at least 20 inches extended from cardboard. The cardboard size can be varied depending on the size of papers dispensed for recycling.

Twenty-five such cardboards put one on another can be sold to customers through stores. A packet this quantity may have a thickness of less than three inches. This should supply a family of three for six months.

Dispensers for junk mails and small paper items should have additional features. It should be folded like a box. A box 11 inches×9 inches×2 ½ inches (when folded) may be utilized for most of the small paper items.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A new and improved packaging device for bundling papers to be recycled comprising, in combination:

a planar sheet of cardboard with an upper surface and a lower surface and formed of parallel sheets and a corrugated layer intermediate thereof, the cardboard being of a size and shape substantially that of a newspaper when folded;

a paper cover in a rectangular configuration slightly larger than that of the cardboard, the paper cover being adhered over the majority of its central extent to the lower surface of the cardboard and with peripheral edges folded over and adhesively adhered to the upper surface of the cardboard around the periphery thereof, each side edge of the periphery being formed with a centrally located slot for the receipt of a tie string;

a pair of tie strings positionable at right angles to each other and crossing at the center point of the cardboard between the cardboard and the cover, the tie strings, extending beyond the periphery of the cardboard and the cover to constitute tie strings positionable over a quantity of newspapers supported on the upper surface of the cardboard and periphery, the ends of the strings including securement tape; and a supplemental sheet of cardboard of essentially the same size and shape as that of the sheet of cardboard and positionable over the topmost piece of paper in the stack on the cardboard, the strings being of sufficient length to extend upwardly over the newspaper and supplemental sheet of upper cardboard for tying thereof to create a secure bundle of newspapers for being recycled.

2. The device as set forth in claim 1 and further including: a supplemental sheet of cardboard of essentially the same size and shape as that of the cardboard base positionable over the topmost piece of paper in the stack on the cardboard base, the strings being of sufficient length to extend upwardly over the newspaper and upper cardboard for tying thereof to create a secure bundle of newspapers for being recycled.

3. A packaging device for bundling papers to be recycled comprising:

a planar sheet of cardboard with an upper surface and a lower surface and formed of parallel sheets and a corrugated layer intermediate thereof, the cardboard being of a size and shape substantially that of a newspaper when folded;

a paper cover in a rectangular configuration slightly larger than that of the cardboard, the paper cover being adhered over the majority of its central extent to the lower surface of the cardboard and with peripheral edges folded over and adhesively adhered to the upper surface of the cardboard around the periphery thereof, each side edge of the periphery being formed with a centrally located slot for the receipt of a tie string; and a pair of tie strings positionable at right angles to each other and crossing at the center point of the cardboard between the cardboard and the cover, the tie strings extending beyond the periphery of the cardboard and the cover to constitute tie strings positionable over a quantity of newspapers supported on the upper surface of the cardboard and periphery.

* * * * *